US006302771B1

(12) United States Patent
Liu et al.

(10) Patent No.: US 6,302,771 B1
(45) Date of Patent: Oct. 16, 2001

(54) CMP PAD CONDITIONER ARRANGEMENT AND METHOD THEREFOR

(75) Inventors: Albert H. Liu; Landon Vines, both of San Antonio, TX (US)

(73) Assignee: Philips Semiconductor, Inc., Tarrytown, NY (US)

( * ) Notice: Subject to any disclaimer, the term of this patent is extended or adjusted under 35 U.S.C. 154(b) by 0 days.

(21) Appl. No.: 09/283,049

(22) Filed: Apr. 1, 1999

(51) Int. Cl.[7] ..... B24B 1/00
(52) U.S. Cl. ..... 451/56; 451/443; 451/444
(58) Field of Search ..... 451/56, 41, 42, 451/66, 111, 109, 443, 442, 444; 15/29, 180, 21.1

(56) References Cited

U.S. PATENT DOCUMENTS 3,074,088 * 1/1963 Williams ..... 15/29
5,384,986 * 1/1995 Hirose et al. ..... 451/444
5,421,768 * 6/1995 Fujiwara et al. ..... 451/288
5,531,635 * 7/1996 Mogi et al. ..... 451/443
5,616,069 * 4/1997 Walker et al. ..... 451/444
5,664,990 * 9/1997 Adams et al. ..... 451/60
5,667,433 * 9/1997 Mallon ..... 451/443
5,679,063 * 10/1997 Kimura et al. ..... 451/60
5,868,608 * 2/1999 Allman et al. ..... 451/443
5,885,147 * 3/1999 Kreagger et al. ..... 451/444
5,916,010 * 6/1999 Varian et al. ..... 451/443

* cited by examiner

*Primary Examiner*—Derris H. Banks

(57) ABSTRACT

According to an example embodiment, the present invention comprises a CMP pad conditioner arrangement. An inlet is configured and arranged for receiving treatment elements. A distribution surface is coupled to the inlet and is configured and arranged to disperse the treatment elements. A multitude of outlets are coupled to the distribution surface and are configured and arranged to dispense the treatment elements onto a CMP pad. Benefits of using this embodiment include enhanced pad cleaning, better slurry dispense, improved wafer quality, and faster production.

23 Claims, 3 Drawing Sheets

CM P PAD CONDITIONER ARRANGEMENT AND METHOD THEREFOR

FIELD OF THE INVENTION

The present device relates generally to semiconductor devices and their fabrication and, more particularly, to semiconductor devices and tools for their manufacture involving chemical-mechanical polishing (CMP).

BACKGROUND OF THE INVENTION

The electronics industry continues to rely upon advances in semiconductor manufacturing technology to realize higher-functioning devices while improving reliability and cost. For many applications, the manufacture of such devices is complex, and maintaining cost-effective manufacturing processes while concurrently maintaining or improving product quality is difficult to accomplish. As the requirements for device performance and cost become more demanding, realizing a successful manufacturing process becomes more difficult.

A byproduct of the increased complexity of semiconductor devices includes uneven device surfaces, which become more prominent as additional levels are added to multilevel-interconnection schemes and circuit features are scaled to submicron dimensions. Typically, each level within the device is patterned, resulting in a surface with varied "step-heights" where metal forming the pattern remains on the surface.

Planarization is a term describing the surface geometry of a semiconductor device. Complete planarization occurs when the surface of the dielectric is flat, as in a plane. No planarization occurs when the surface of the dielectric directly models the "step-height" surface of the metal pattern in the layer underneath. The degree of planarization refers to the degree to which the varied surface geometry can be "planarized," or smoothed out into a planar surface. Varied surface geometry is often undesirable. Therefore, as additional layers are formed within devices, the required degree of planarization increases.

A commonly used new planarization process in semiconductor device manufacturing is chemical-mechanical polishing, or CMP. CMP is useful in the planarization of silicon wafers and of VLSI circuits between different manufacturing processes. CMP is a popular planarization method, due in part to its usefulness in the global planarization of semiconductor devices. Traditional planarization processes are restricted to effecting local planarity or topographical variation on a small scale, whereas CMP is often useful on a global scale greater than ten microns.

In one application, a CMP process involves securing a semiconductor wafer to a wafer holder with the wafer located face-down on a polish pad. Both the polish pad and the wafer holder rotate. A slurry, typically a colloidal silica that is a suspension of $SiO_2$ particles, is applied to the process. The particle size typically varies from 100 angstroms to 3 microns. The slurry is generally applied using a wand feeding to the wafer holder and pad. The rate of removal of material from the wafer is a combination of chemical and mechanical rates. The mechanical removal rate is roughly proportional to the pressure and the relative velocity of the wafer. The chemical removal rate is a function of the size of the slurry particles and the solution pH, wherein the maximum removal rate is generally obtained using a slurry having a pH of about 11.5.

In addition to the use of slurry in the CMP process, a conditioner is also typically used for conditioning the polish pad. The conditioner aids in the CMP polishing process and contributes to the longevity of the pad. Another need in the CMP process is for adequately and efficiently cleaning the pad and the wafer itself. In clean room environments, it is important to maintain a CMP process that produces as few contaminants as possible. Since the slurry particle size ranges in the sub-3 micron range, clean-up is difficult and thus of high importance. In addition, it is helpful to prevent the byproduct resulting from the polishing of each wafer from accumulating on the pad and reaching additional wafers.

The traditional method for conditioning the pad and dispensing slurry is to use two separate mechanical components: a slurry dispense wand and a pad conditioner assembly. There are disadvantages in using two separate components. For instance, the slurry cannot be spread uniformly across the pad and may accumulate in the pad conditioning head. The non-uniform distribution of slurry distribution hinders the polishing process. In addition, the reaction byproduct cannot be thoroughly removed from the pad. When more than one wafer is processed at once, inadequate cleaning of the pad results in the reaction byproduct and other materials from one wafer coming into contact with other wafers. These disadvantages may result in, for example, long arc style scratches, shallow micro-scratches, inter-die thickness variation, and residual slurry particles. These disadvantages ultimately result in a significant yield lost and in reliability problems due in part to possible metal stringers in the shallow scratch area and surrounding residual slurry particles.

SUMMARY OF THE INVENTION

The present invention is directed to a method and apparatus for improving the CMP process, the improvements including but not limited to enhanced pad cleaning and conditioning, better slurry dispense, improved wafer quality, and faster production. The present invention is exemplified in a number of implementations and applications, some of which are summarized below.

According to an example embodiment, the present invention comprises a CMP pad conditioner arrangement. The arrangement includes an inlet for receiving treatment elements. A distribution surface is coupled to the inlet and is configured and arranged to uniformly disperse the treatment elements. A multitude of outlets are coupled to the distribution surface and are configured and arranged to dispense the treatment elements onto the CMP pad.

According to another example embodiment, the present invention is directed to a CMP polishing machine. The machine includes the pad conditioner arrangement described in the preceding paragraph.

The invention is directed to a CMP pad conditioner arrangement, according to another example embodiment. The arrangement comprises means for receiving treatment elements, means for distributing treatment elements, and means for conditioning the pad.

According to still another example embodiment, the present invention is directed to a method for conditioning a CMP pad using a conditioner apparatus having an inlet, a distribution surface coupled to the inlet, and a multitude of outlets. Treatment elements are supplied to the apparatus via the inlet. The treatment elements are dispersed and distributed via the distribution surface onto the CMP pad via the multitude of outlets.

The above summary of the present invention is not intended to describe each illustrated embodiment or every implementation of the present invention. The figures and detailed description which follow more particularly exemplify these embodiments.

BRIEF DESCRIPTION OF THE DRAWINGS

The invention may be more completely understood in consideration of the following detailed description in connection with the accompanying drawings, in which.

Figure 1B:
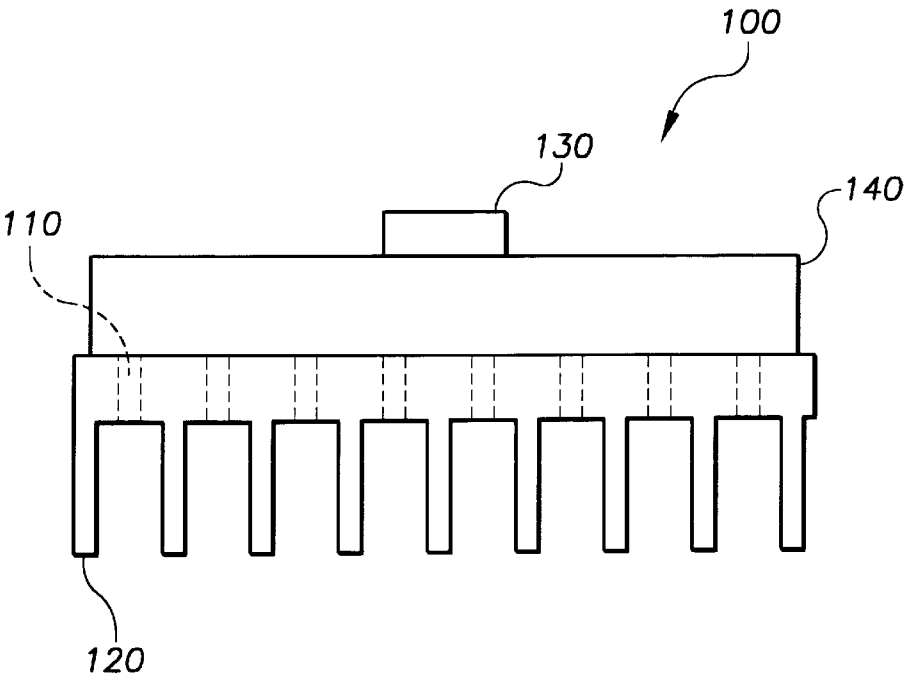
FIG. 1B shows a side view of a first CMP pad conditioner arangement, according to an example embodiment of the present invention.

While the invention is amenable to various modifications and alternative forms, specifics thereof have been shown by way of example in the drawings and will be described in detail. It should be understood, however, that the intention is not to limit the invention to the particular embodiments described. On the contrary, the intention is to cover all modifications, equivalents, and alternatives falling within the spirit and scope of the invention as defined by the appended claims.

DETAILED DESCRIPTION

According to an example embodiment, the present invention is directed to an arrangement for use in a CMP process. The arrangement includes capabilities for receiving, dispersing, and dispensing treatment elements, as well as for conditioning the CMP pad. In addition, the arrangement may also include the capability of rotation. The conditioning of the pad may include, for example, removing deposits, roughing the pad, or other preparations for use in the CMP process. The arrangement includes an inlet port for receiving treatment elements. A distribution surface is coupled to the inlet port and is configured and arranged to disperse the treatment elements. A multitude of outlet ports are coupled to the distribution surface and are configured and arranged to dispense the treatment elements onto the CMP pad.

Figure 1A:
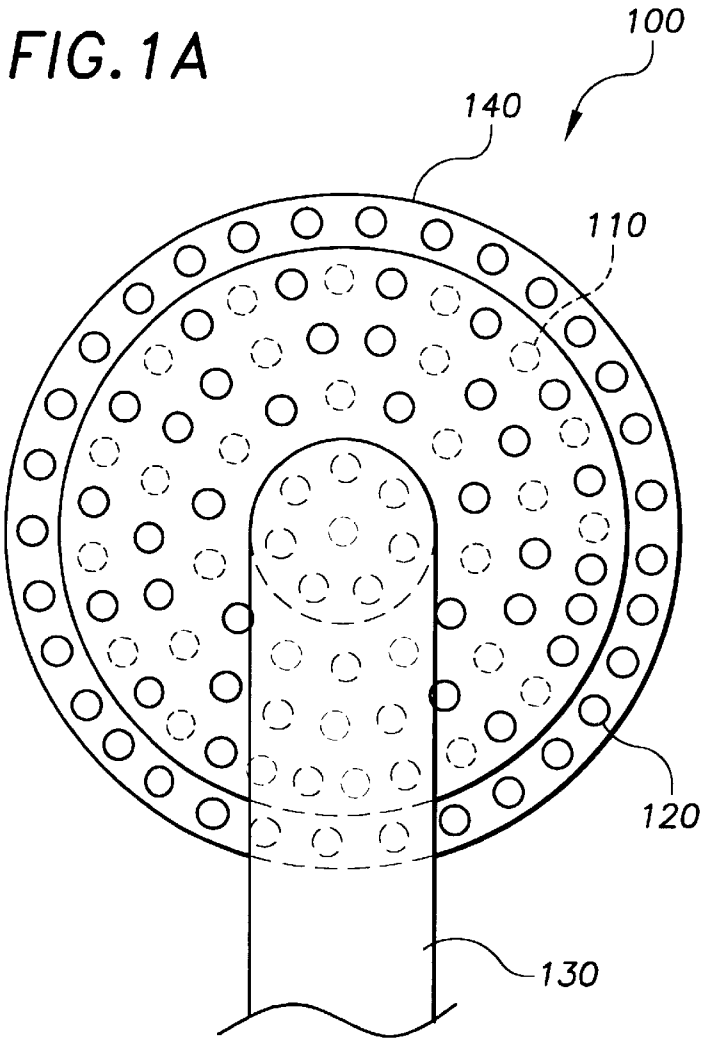
FIG. 1A shows a top view of a first CMP pad conditioner arrangement, according to an example embodiment of the present invention.

FIG. 1A shows a top and FIG. 1B a side view of a CMP pad conditioner arrangement 100 for use in a CMP process, according to another embodiment of the present invention. Both FIGS. 1A and 1B use the same reference numbers to correspond to the same aspects shown in each figure. Supply 130 is configured and arranged to supply treatment elements to the pad conditioner head 140. Pad conditioner head 140 includes holes 110 for dispensing treatment elements to the surface to be conditioned. Brushes 120 are coupled to the pad conditioner head 140. The brushes may, for instance, comprise chemically resistant material, such as plastic or Teflon. The use of chemically resistant brushes is particularly advantageous in applications where the treatment elements include chemicals that are reactive with non-chemically resistant brush material.

According to another example embodiment, a method for conditioning a CMP pad is provided. Referring again to FIGS. 1A and 1B, supply 130 is coupled to pad conditioner head 140. Treatment elements are delivered to the pad conditioner head 140 by way of supply 130. The treatment elements may include, for example, chemicals ranging in pH from highly basic to highly acidic, or solvents such as de-ionized (DI) water. The treatment elements are dispersed in the head 140, and dispensed through holes 110. Brushes 120 are coupled to pad conditioner head 140, and are caused to contact a CMP pad. The treatment elements are dispersed onto the CMP pad, and the CMP pad is conditioned. Conditioning the CMP pad may, for instance, also include rotating the pad conditioner head 140, in a manner such as rotating about its center.

Figure 2B:
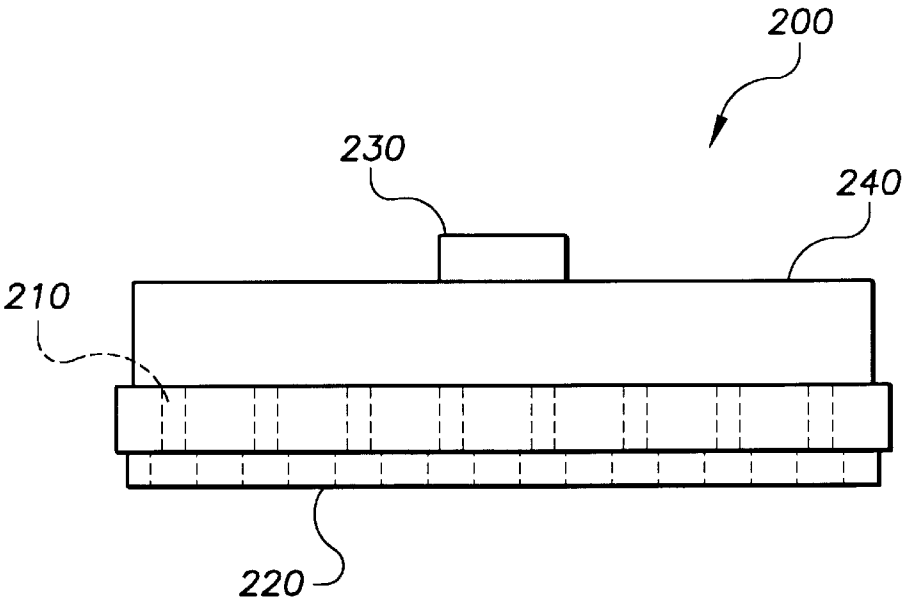
FIG. 2B shows a side view of a second CMP pad conditioner arrangement, according to another example embodiment of the present invention.
Figure 2A:
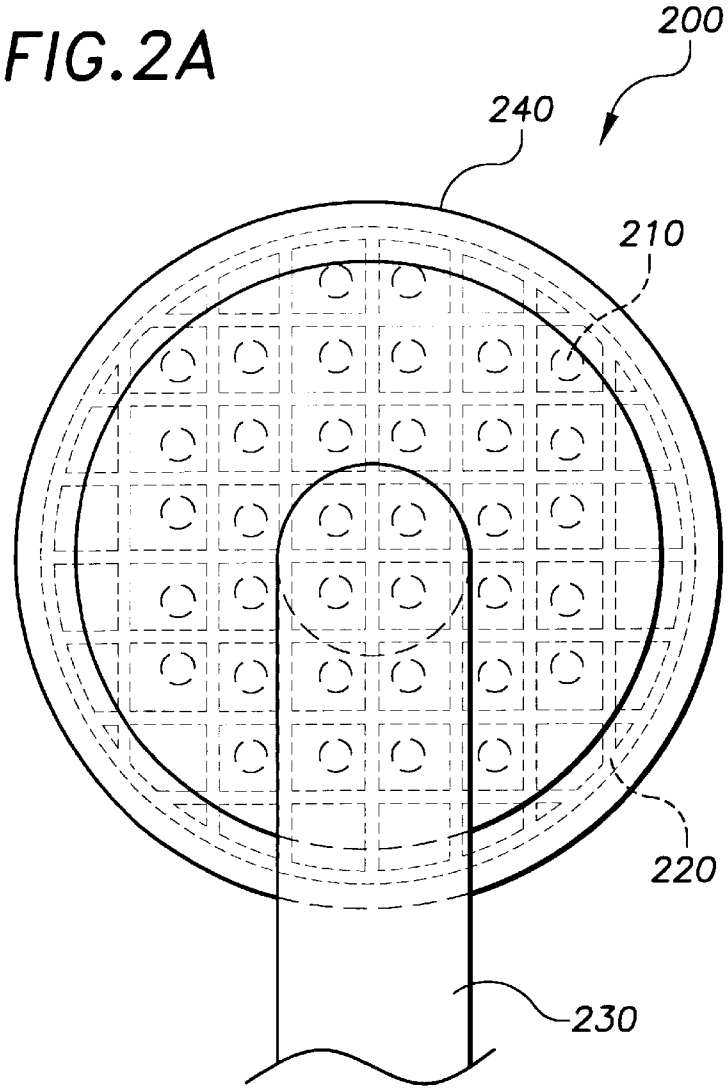
FIG. 2A shows a top view of a second CMP pad conditioner arrangement, according to another example embodiment of the present invention.

FIG. 2A shows a top and FIG. 2B shows a side view of a CMP pad conditioner arrangement 200 for use in a CMP process, according to another example embodiment of the present invention. Both FIGS. 2A and 2B use the same reference numbers to correspond to the same aspects shown in each figure. Supply 230 is configured and arranged to supply treatment elements to the pad conditioner head 240. Pad conditioner head 240 includes holes 210, for dispensing treatment elements to the surface to be conditioned. Grid arrangement 220 is coupled to the pad conditioner head 240. For instance, grid arrangement 220 may include material such as diamond or CVD diamond coated with Ni.

According to yet another example embodiment, a method for conditioning a CMP pad is provided. Referring again to FIGS. 2A and 2B, supply 230 is coupled to pad conditioner head 240. Treatment elements are delivered to the pad conditioner head 240 by way of supply 230. The treatment elements are dispersed in the head 240, and dispensed through holes 210. Grid arrangement 220 is coupled to pad conditioner head 240, and is caused to contact a CMP pad. The treatment elements are dispersed onto the CMP pad, and the CMP pad is conditioned. Conditioning the CMP pad may, for instance, also include rotating the pad conditioner head 240, in a manner such as rotating about its center using a motor/axle arrangement (not shown) coupled to the housing for the supply 230 (or 130).

Figure 3B:
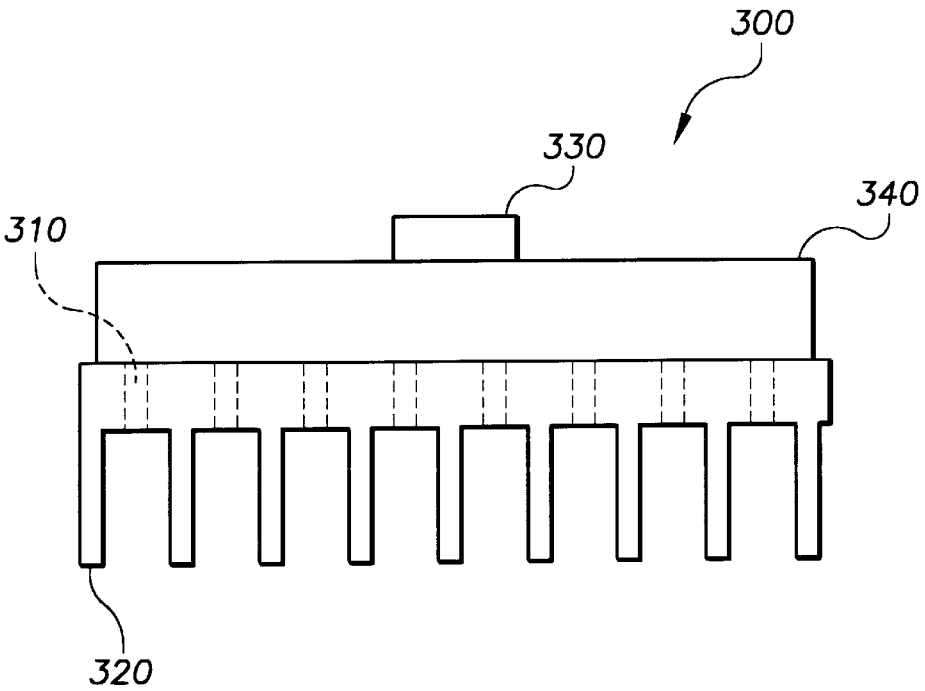
FIG. 3B shows a side view of a third CMP pad conditioner arrangement, according to another example embodiment of the present invention.
Figure 3A:
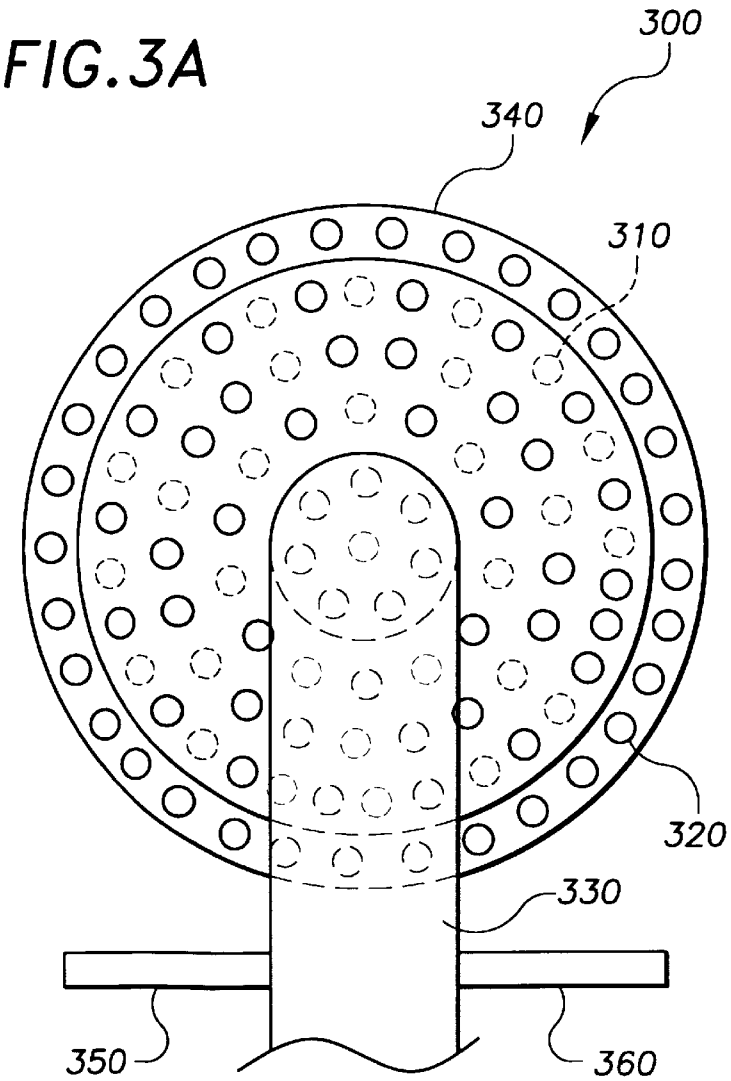
FIG. 3A shows a top view of a third CMP pad conditioner arrangement, according to another example embodiment of the present invention.

FIG. 3A shows a top and FIG. 3B shows a side view of a CMP pad conditioner arrangement 300 for cleaning a pad in a CMP process, according to another example embodiment of the present invention. Both FIGS. 3A and 3B use the same reference numbers to correspond to the same aspects shown in each figure. Treatment element supplies 350 and 360 are configured and arranged to supply elements to supply 330. Supply 330 is configured and arranged to supply treatment elements to the pad conditioner head 340. Pad conditioner head 340 includes holes 310, for dispensing treatment elements to the surface to be conditioned. Brushes 320 are coupled to the pad conditioner head 340.

According to another example embodiment, a method for conditioning a CMP pad is provided. Referring again to FIGS. 3A and 3B, treatment element supplies 350 and 360 are coupled to supply 330. Supply 330 is coupled to pad conditioner head 340. Treatment elements are delivered to pad conditioner head 340 by way of supply 330. The treatment elements are dispersed in the head 340, and dispensed through holes 310. Brush arrangement 320 is coupled to pad conditioner head 340, and is caused to contact a CMP pad. The treatment elements are dispersed onto the CMP pad, and the CMP pad is conditioned. Conditioning the CMP pad may, for instance, also include rotating the pad conditioner head 340, in a manner such as rotating about its center.

Treatment element supplies 350 and 360 may be used to supply several different elements. For instance, one supply may be used to supply chemicals, and the other used to supply DI water. In an example embodiment, pad conditioner arrangement 300 is used in connection with a metal polish process, in which the chemical supply includes a low pH chemical. In another example embodiment, pad conditioner arrangement 300 is used in an oxide polish process, in which the chemical supply includes a high pH chemical, such as, for example, a chemical having a pH of about 11.5.

Skilled artisans will recognize that the above-discussed example embodiments may be implemented by modifying commercially-available equipment. Examples of such equipment include MIRRA and 6DS SP, respectively manufactured by Applied Material and Strausbough.

While the present invention has been described with reference to several particular example embodiments, those skilled in the art will recognize that many changes may be made thereto. For example, many features of the above embodiments are combinable in a single conditioner arrangement and/or conditioning process. Such changes do not depart from the spirit and scope of the present invention, which is set forth in the following claims.

What is claimed is:

1. A CMP pad conditioner arrangement, comprising:

at least one inlet port adapted to receive treatment elements;

a distribution surface coupled to the inlet port and configured and arranged to disperse the treatment elements;

a rotation device configured to rotate the distribution surface; and a multitude of outlet ports coupled to the distribution surface and configured and arranged to dispense the treatment elements onto a CMP pad.

2. A CMP pad conditioner arrangement, according to claim 1, further comprising a brush arrangement.

3. A CMP pad conditioner arrangement, according to claim 2, wherein the brush arrangement comprises Teflon.

4. A CMP pad conditioner arrangement, according to claim 2, wherein the brush arrangement comprises at least one of: plastic and metal.

5. A CMP pad conditioner arrangement, according to claim 2, wherein the brush arrangement is chemically inactive.

6. A CMP pad conditioner arrangement, according to claim 2, wherein the brush arrangement is chemically inactive with solutions having a pH of about 11.5.

7. A CMP pad conditioner arrangement, according to claim 1, further comprising a grid arrangement.

8. A CMP pad conditioner arrangement, according to claim 7, wherein the grid arrangement includes a diamond material.

9. A CMP pad conditioner arrangement, according to claim 7, wherein the grid arrangement comprises at least one of: Ni and Teflon.

10. A method for conditioning a CMP pad, comprising:

providing a conditioner apparatus having at least one inlet port, a distribution surface coupled to the inlet port, and a multitude of outlet ports;

receiving treatment elements via an inlet port;

rotating the conditioner apparatus; and dispersing the treatment elements via the distribution surface and dispensing the treatment elements onto the CMP pad via the multitude of outlet ports.

11. A method for conditioning a CMP pad, according to claim 10, wherein the conditioner apparatus includes at least one of: a grid; a brush, and a disk.

12. A method for conditioning a CMP pad, according to claim 11, further comprising using the conditioner apparatus for removing deposits on the pad.

13. A method for conditioning a CMP pad, according to claim 11, further comprising using the conditioner apparatus for roughing the pad.

14. A method for conditioning a CMP pad, according to claim 10, wherein the conditioner apparatus includes at least one of: a grid; a brush; and a disk.

15. A method for conditioning a CMP pad, according to claim 10, wherein the conditioner apparatus further comprises at least two inlet supplies coupled to the inlet port, the method further comprising:

supplying at least one chemical to the inlet port by way of an inlet supply; and supplying DI water to the inlet port by way of another inlet supply.

16. A method for conditioning a CMP pad, according to claim 15, wherein the chemical includes a low pH chemical.

17. A method for conditioning a CMP pad, according to claim 15, wherein the chemical includes a high pH chemical.

18. A method for conditioning a CMP pad, according to claim 15, for use in a metal polish operation.

19. A method for conditioning a CMP pad, according to claim 15, for use in a dielectric polish operation.

20. A CMP pad conditioner arrangement, comprising:

means for receiving treatment elements;

means for distributing treatment elements;

outlet means, coupled to the means for distributing treatment elements, for dispensing treatment elements onto a CMP pad;

means for conditioning the pad; and means for rotating the conditioning means.

21. A CMP pad conditioner arrangement comprising:

a rotatable distribution surface configured and arranged to disperse a plurality of treatment elements received from at least one inlet port while the distribution surface rotates;

a dispenser, including a plurality of ports, coupled to the distribution surface and configured and arranged to pass the treatment elements onto a CMP pad; and means for scrubbing the CMP pad, said means comprising material selected from the group of: teflon, plastic, metal, chemically inert material, diamond, and nickel.

22. A CMP pad conditioner arrangement, according to claim 21, wherein the scrubbing means further includes means for securing the scrubbing material.

23. A CMP pad conditioner arrangement, according to claim 21, wherein the scrubbing means is a material selected from the group of: teflon, plastic, metal, chemically inert material, diamond, and nickel.

* * * * *